US008342357B1

(12) United States Patent
Grubb et al.

(10) Patent No.: US 8,342,357 B1
(45) Date of Patent: Jan. 1, 2013

(54) PARTITION SUPPORT AND CANISTER ASSEMBLIES FOR PACKAGING CONTENTS AND METHODS OF CONTAINING SAME

(75) Inventors: Robert L. Grubb, Ellicott City, MD (US); Jayant R. Bondre, Clarksville, MD (US); Peter Shih, Ellicott City, MD (US); Ioan Florea, Rockville, MD (US); Marlin L. Stoltz, Calera, AL (US)

(73) Assignee: Transnuclear, Inc., Columbia, MD (US)

( * ) Notice: Subject to any disclaimer, the term of this patent is extended or adjusted under 35 U.S.C. 154(b) by 392 days.

(21) Appl. No.: 12/535,501

(22) Filed: Aug. 4, 2009

Related U.S. Application Data

(60) Provisional application No. 61/086,079, filed on Aug. 4, 2008.

(51) Int. Cl.
*B65D 25/06* (2006.01)
*B65D 57/00* (2006.01)
*B65D 85/00* (2006.01)

(52) U.S. Cl. ..... 220/529; 220/528; 220/533

(58) Field of Classification Search ..... 220/507, 220/510, 528, 529, 5.2, 533, 552, 553, 554, 220/62.11, 62.17, 532; 206/499, 561
See application file for complete search history.

(56) References Cited

U.S. PATENT DOCUMENTS 1,292,935 A * 1/1919 Walsh ..... 220/504
1,523,136 A * 1/1925 O'Connor ..... 220/533
2,655,882 A * 10/1953 Tripp ..... 109/79
2,718,326 A * 9/1955 Le Blanc ..... 220/533
3,220,602 A * 11/1965 Ficker ..... 220/62.17
7,163,118 B2 * 1/2007 Cheng ..... 220/528
7,628,287 B1 * 12/2009 Arnold ..... 220/62.22

* cited by examiner

*Primary Examiner* — Harry Grosso
(74) *Attorney, Agent, or Firm* — Christensen O'Connor Johnson and Kindness PLC

(57) ABSTRACT

A partition support assembly for a canister assembly generally includes at least one inner support ring configured to support one or more partitions for dividing the interior of the canister assembly for packaging contents to be received within the canister assembly, wherein the one or more partitions are configurable in a plurality of packaging orientations. A canister assembly and a method for containing packaging contents are also provided.

20 Claims, 10 Drawing Sheets

PARTITION SUPPORT AND CANISTER ASSEMBLIES FOR PACKAGING CONTENTS AND METHODS OF CONTAINING SAME

CROSS-REFERENCE TO RELATED APPLICATION

This application claims the benefit of U.S. Provisional Application No. 61/086,079, filed Aug. 4, 2008, the disclosure of which is hereby expressly incorporated by reference.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a canister assembly is provided. The canister assembly generally includes an outer wall, an inner wall disposed within the outer wall, and at least one inner support ring disposed within the inner wall. The at least one inner support ring is configured to support one or more partitions for dividing the interior of the canister assembly for packaging contents to be received within the canister assembly, wherein the one or more partitions are configurable in a plurality of packaging orientations.

In accordance with another embodiment of the present disclosure, a partition assembly for a canister assembly is provided. The partition assembly generally includes at least one support ring configured to support at least one partition for dividing the interior of the partition support assembly for packaging irradiated hardware, wherein the partition support assembly is configurable in a plurality of packaging orientations.

In accordance with yet another embodiment of the present disclosure, a method of containing packaging contents is provided. The method generally includes loading a first packaging content in a portion of a canister assembly; containing the canister assembly in an overpack assembly for a first period of time; removing the canister assembly from the overpack assembly, opening the canister assembly, and loading a second packaging content in another portion of the canister assembly; and containing the canister assembly in the overpack assembly for a second period of time.

DESCRIPTION OF THE DRAWINGS

The foregoing aspects and many of the attendant advantages of embodiments of the present disclosure will become more readily appreciated as the same become better understood by reference to the following detailed description, when taken in conjunction with the accompanying drawings, wherein.

DETAILED DESCRIPTION

Figure 1:
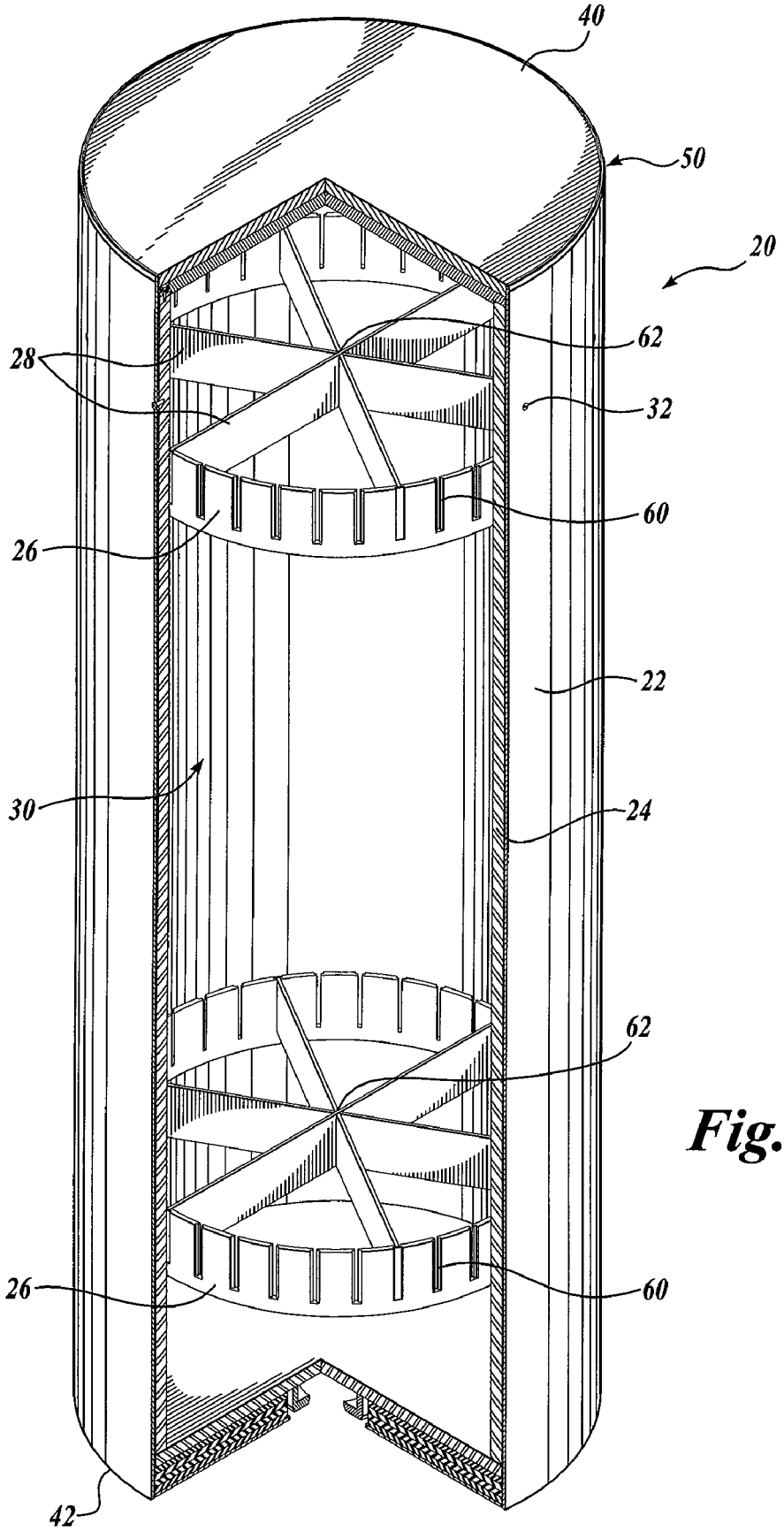
FIG. 1 is a perspective cut-away front view of a canister assembly in accordance with one embodiment of the present disclosure.

Embodiments of the present disclosure are generally directed to storage systems for packaging contents, such as irradiated hardware, contaminated material, and like components. Referring to FIGS. 1-4, there is shown a canister assembly, generally indicated 20, constructed in accordance with one embodiment of the present disclosure. The canister assembly 20 generally includes an outer wall 22, an inner wall 24 disposed within the outer wall 22, and a configurable partition support assembly 25 disposed within the inner wall 24. In the illustrated embodiment, the partition support assembly 25 includes at least one inner support ring 26 disposed within the inner wall 24 configured to support one or more partitions 28 for dividing the interior 30 of the canister assembly 20 for packaging contents, such as irradiated hardware, contaminated material, and like components. The partitions 28 are designed to be configurable in a plurality of packaging orientations to accommodate various packaging contents.

Irradiated hardware as defined herein includes non-fissile materials, components, and/or hardware exposed to high-energy radiation resulting in cross-linking of molecules. Such irradiated hardware is therefore radioactive material that must be contained so as not to endanger the general public or the environment. Irradiated hardware may generally refer to shipments of exceptionally high levels of radioactivity that require clearing the site and special offloading at appropriate disposal sites. These shipments may include payload or contents from CNS3-55, TN-RAM, and other horizontally or vertically offloaded cask shipments. In addition to items of irradiated hardware, shipments considered irradiated hardware, for purposes of disposal, also may include certain sealed sources and materials with exceptionally high levels of radioactivity. Shipments may also include greater than Type A radioactive material, such as fissile material, provided such fissile material does not exceed the mass limits set forth in U.S. federal rule, 10 C.F.R. §71.15.

Although generally directed to packaging irradiated hardware, embodiments of the present disclosure may be used in conjunction with other contents besides and/or in addition to irradiated hardware, such as contaminated components and materials, non-irradiated components and materials used for handling or physical arrangement in the package, and other miscellaneous materials that are evaluated so as not to challenge the integrity of the package.

Due to the potential radioactivity of the packaging contents, such as irradiated hardware, potentially contained by the canister assemblies, appropriate component dunnage is used when loading irradiated hardware into the interior 30 of the canister assembly 20 to limit the movement of the contents, for example, during accident conditions of transport. As described in greater detail below, as a result of the configurability of the partitions 28 in the interior 30 of the canister assembly 20, the assembly 20 is suitably designed to receive irradiated hardware of varying shapes and sizes in varying packaging orientations. Such a design makes it easier to maintain a suitable packaging orientation for the contents.

It should be appreciated that sub-containers for containing small, partial, and/or chopped packaging materials are also within the scope of the present disclosure. Such sub-containers may be insertable into the canister assembly.

In addition to a configurable system, a lightweight system is also advantageous with minimum use of extra dunnage. In that regard, the contents in canister assemblies, e.g., component dunnage, spacers, inserts, irradiated hardware, etc., generally must fall within specific weight limits for cask shipment and storage. Therefore, embodiments of the present disclosure are designed for optimal weight and spacing configurations.

Canister assemblies described herein may be temporarily or permanently contained, stored, or transported in overpack assemblies. Suitable overpack assemblies may include but are not limited to storage casks, interim on-site storage buildings (IOSBs), and transport casks. As a non-limiting example, a suitable concrete storage cask is described in U.S. Pat. No. 4,800,062, issued to Craig et al., the disclosure of which is hereby expressly incorporated by reference.

Referring to FIGS. 1-4, the canister assembly 20 will now be described in greater detail. As mentioned above, the canister assembly 20 includes an outer wall 22 and an inner wall 24 disposed within the outer wall 22. In the illustrated embodiment, the inner wall 24 is adjacent the outer wall 22, and is attached to the outer wall 22 by an attachment assembly 32. In the illustrated embodiment, the attachment assembly includes a plurality of fasteners 34 extending through holes 36 and 38 in the outer and inner walls 22 and 24 (see FIG. 3).

The outer and inner walls 22 and 24 are suitably made from carbon or stainless steel. As one non-limiting example, the outer wall 22 is made from stainless steel and the inner wall is a thicker wall than the outer wall 22 and is made from carbon steel. However, it should be appreciated that other suitable materials are also within the scope of the present disclosure, including but not limited to alloy steel or any material having suitable strength and corrosion resistance attributes for the application.

As seen in the illustrated embodiment, the canister assembly 20 may be substantially cylindrical in shape. However, it should be appreciated that other non-cylindrical embodiments are also within the scope of the present disclosure, including but not limited to assemblies having square, rectangular, hexagonal cross-sections, etc., or other three-dimensional configurations In the illustrated embodiment, the canister assembly 20 includes a first end 40 and a second end 42. At either of the first or second ends 40 or 42, the canister assembly 20 may include an openable closure assembly 50.

Figure 2:
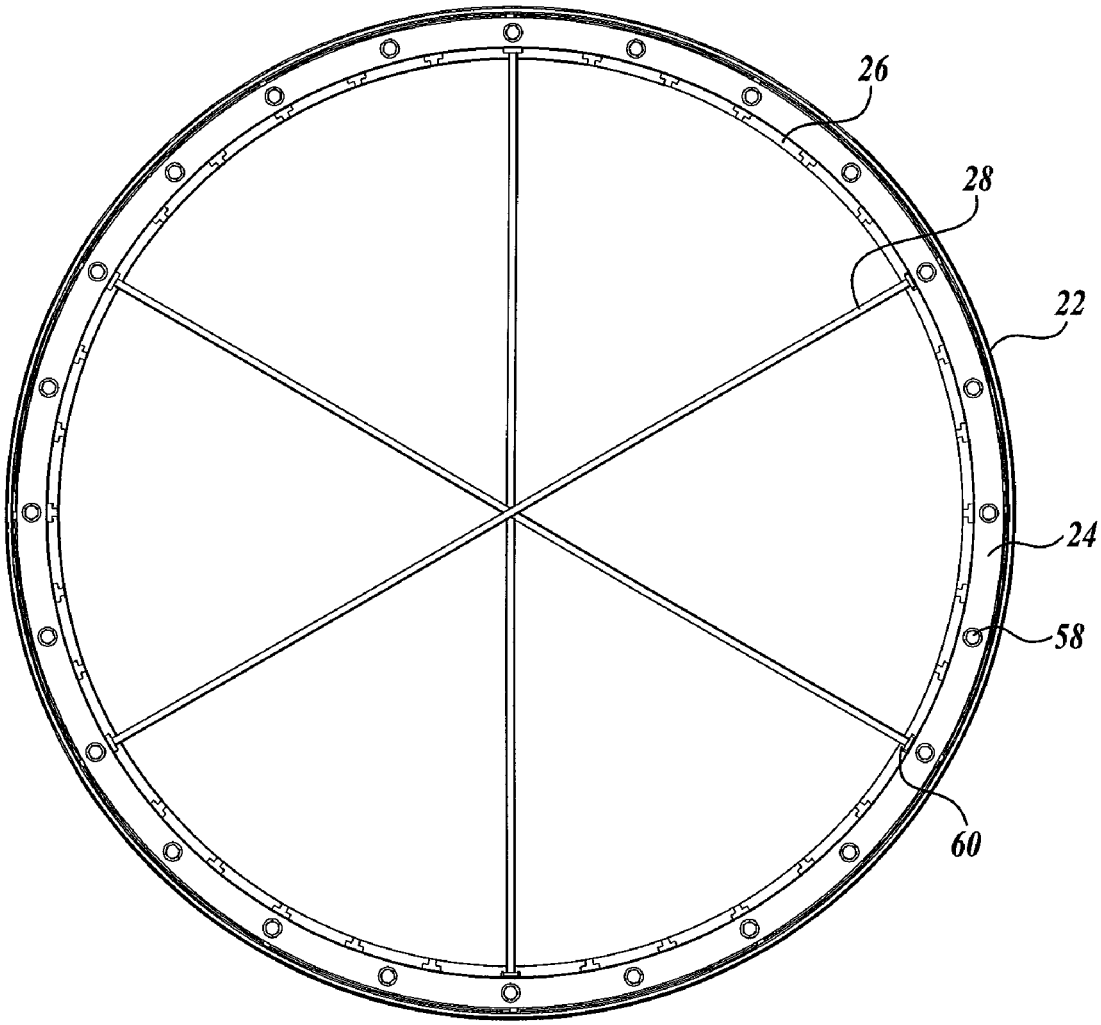
FIG. 2 is a top internal view of the canister assembly of FIG. 1, shown without a closure assembly installed.
Figure 3:
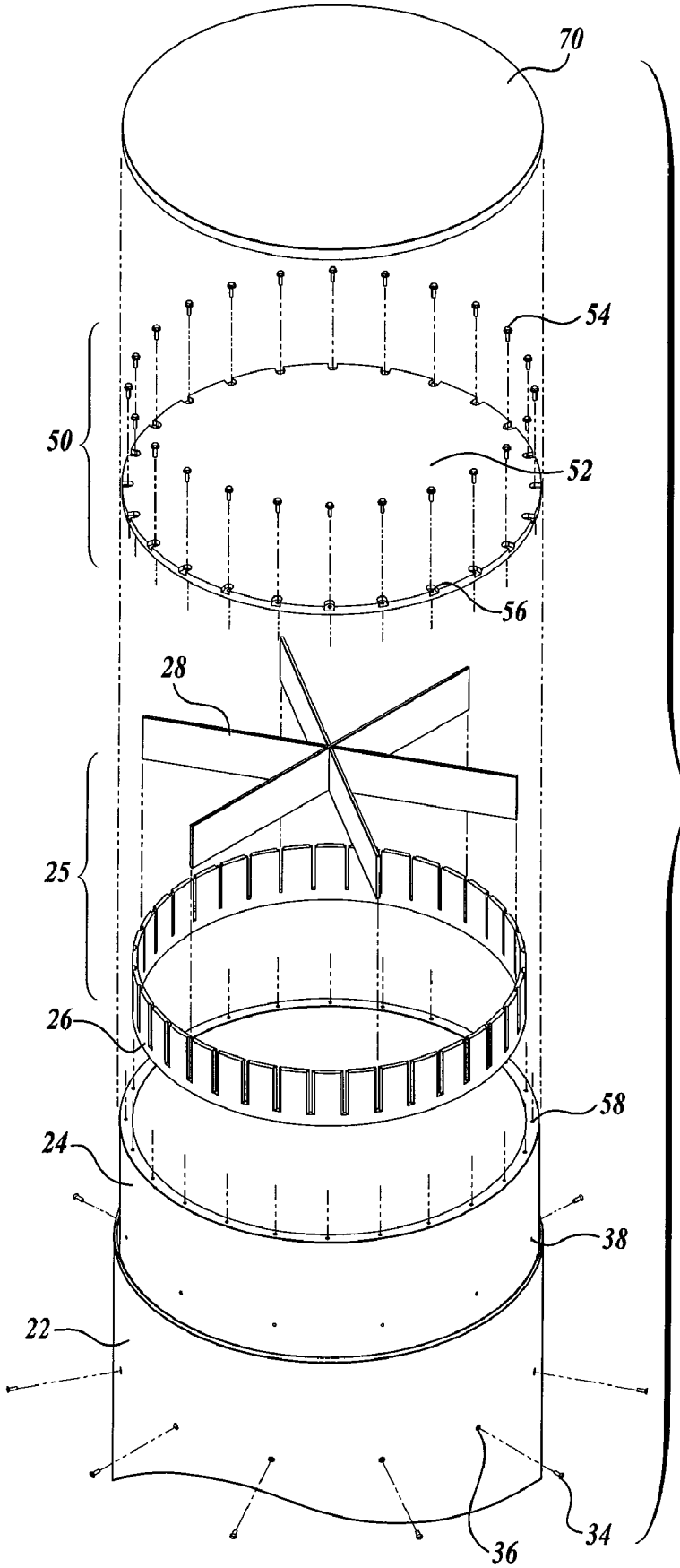
FIG. 3 is a partial exploded view of the canister assembly of FIG. 1.
Figure 4:
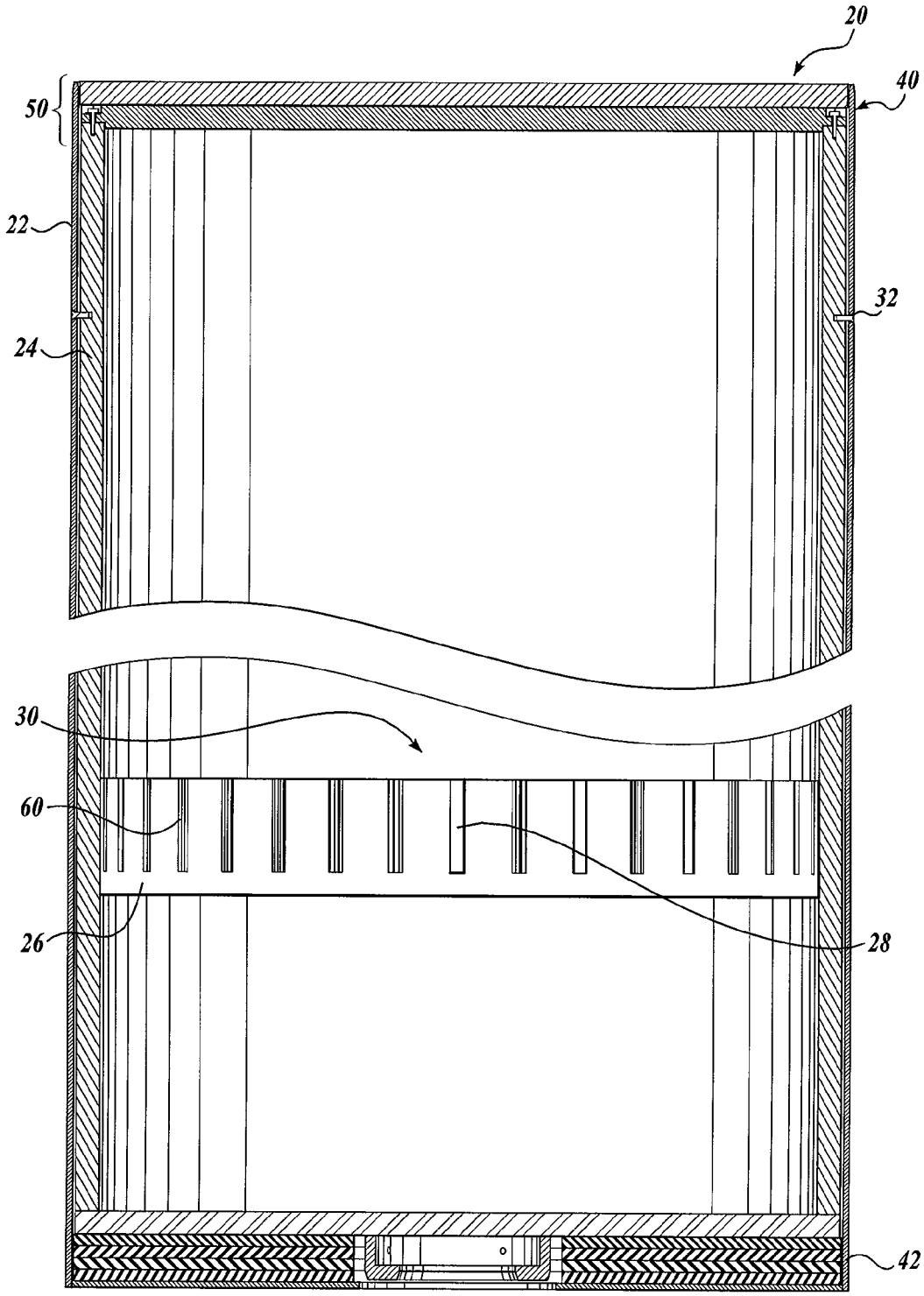
FIG. 4 is a cross-sectional view of the canister assembly of FIG. 1.

In the illustrated embodiment of FIGS. 1-4, the openable closure assembly 50 includes a first closure plate 52 and a plurality of fasteners 54 received through holes 56 in the first closure plate 52 and holes 58 in an upper surface of the inner wall 24 (see FIG. 3). As described in greater detail below, the closure assembly 50 can be opened periodically to add additional irradiated hardware to the canister assembly 20 prior to being sealed for permanent storage. The closure assembly 50 may further include a second closure plate 70, which optionally may be permanently attached to the outer wall 22 (for example, by being welded to the outer wall 22), when the canister assembly 20 no longer need be openable. The closure assembly 50 may further include an optional O-ring seal between the second closure plate 70 and the outer wall 22.

As mentioned above, the partition support assembly 25 is a configurable assembly, universally adaptable to package various packaging contents. In one embodiment, the partition support assembly 25 includes at least one inner support ring 26 disposed within the inner wall 24. In the illustrated embodiment, two inner support rings 26 are positioned adjacent the inner wall 24. However, it should be appreciated that the partition support assembly may include any number of inner support rings to support the partitions. As mentioned above, the inner support rings 26 are configured to support one or more partitions 28 for dividing the interior 30 of the canister assembly 20 for packaging irradiated hardware and like components. Like the inner and outer walls, the inner support rings 26 and partitions 28 may be made from carbon steel or stainless steel or other suitable materials.

The inner support rings 26 include a plurality of notches 60 for slidably receiving the partitions 28. In the illustrated embodiment, the inner support ring 26 is designed with 36 notches so as to be configurable into a plurality of packaging orientations. However, it should be appreciated that any number of notches are within the scope of the present disclosure. In the illustrated embodiment, the notches are oriented normal to an imaginary tangent line at the point the tangent line meets the inner support ring 26. As seen in FIGS. 1 and 2, the partitions 28 extending from the notches 60 extend radially inwardly to a center point 62 from the inner support ring 26.

In the illustrated embodiment, the partitions 28 are configured together as one piece in a 6-pointed star configuration. However, it should be appreciated that multiple elongate partitions 28 may be combined to achieve the 6-pointed star configuration. It should also be appreciated that other configurations, such as 4-pointed, 8-pointed, etc., star configurations are also within the scope of the present disclosure. In addition, a single partition may be used to divide the interior 30 of the container into two semicircle cross-sectional portions. Moreover, it should be appreciated that each inner support ring 26 may have different partition 28 configurations.

Figure 5:
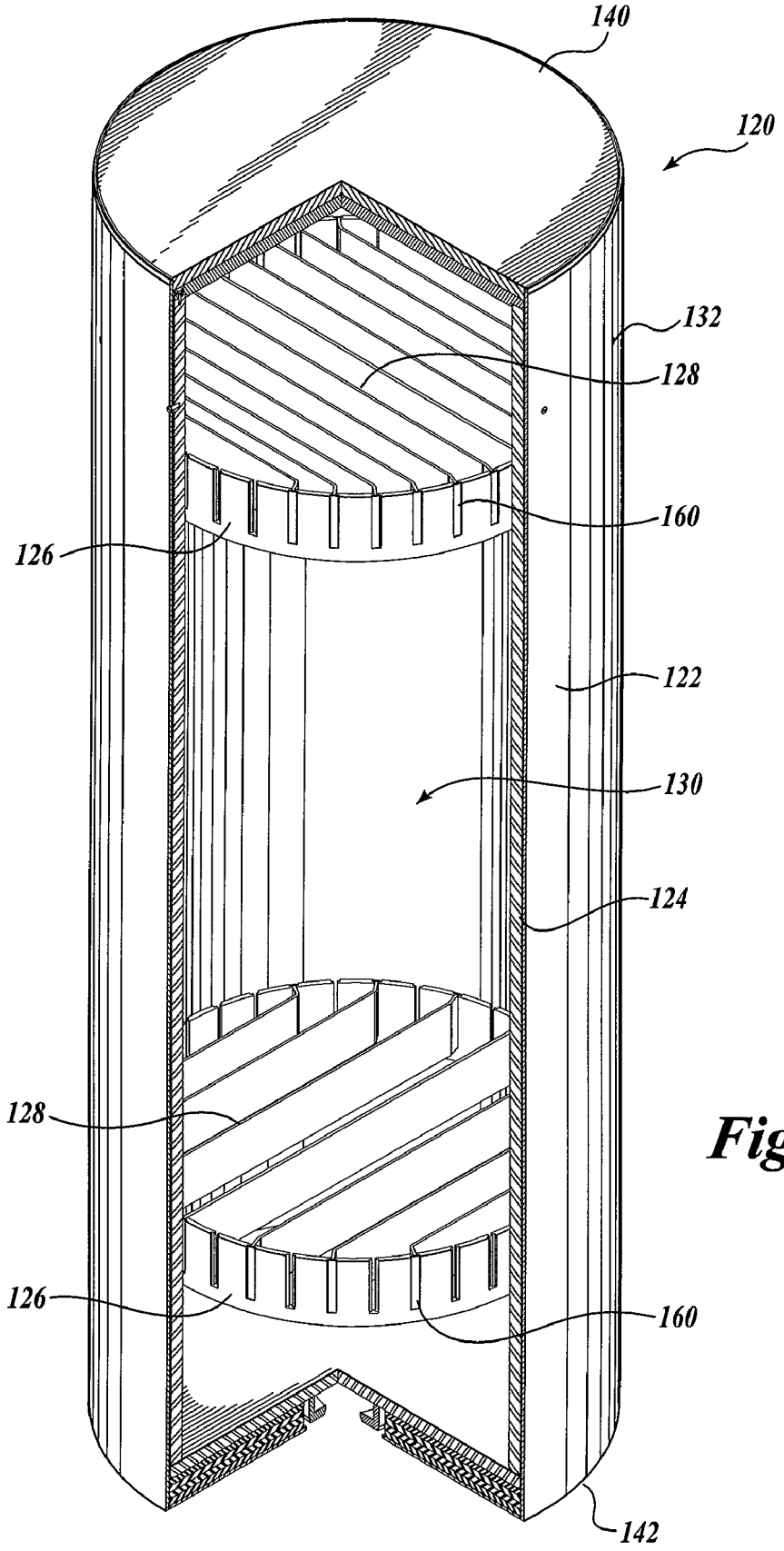
FIG. 5 is a perspective cut-away front view of a canister assembly in accordance with another embodiment of the present disclosure.
Figure 6:
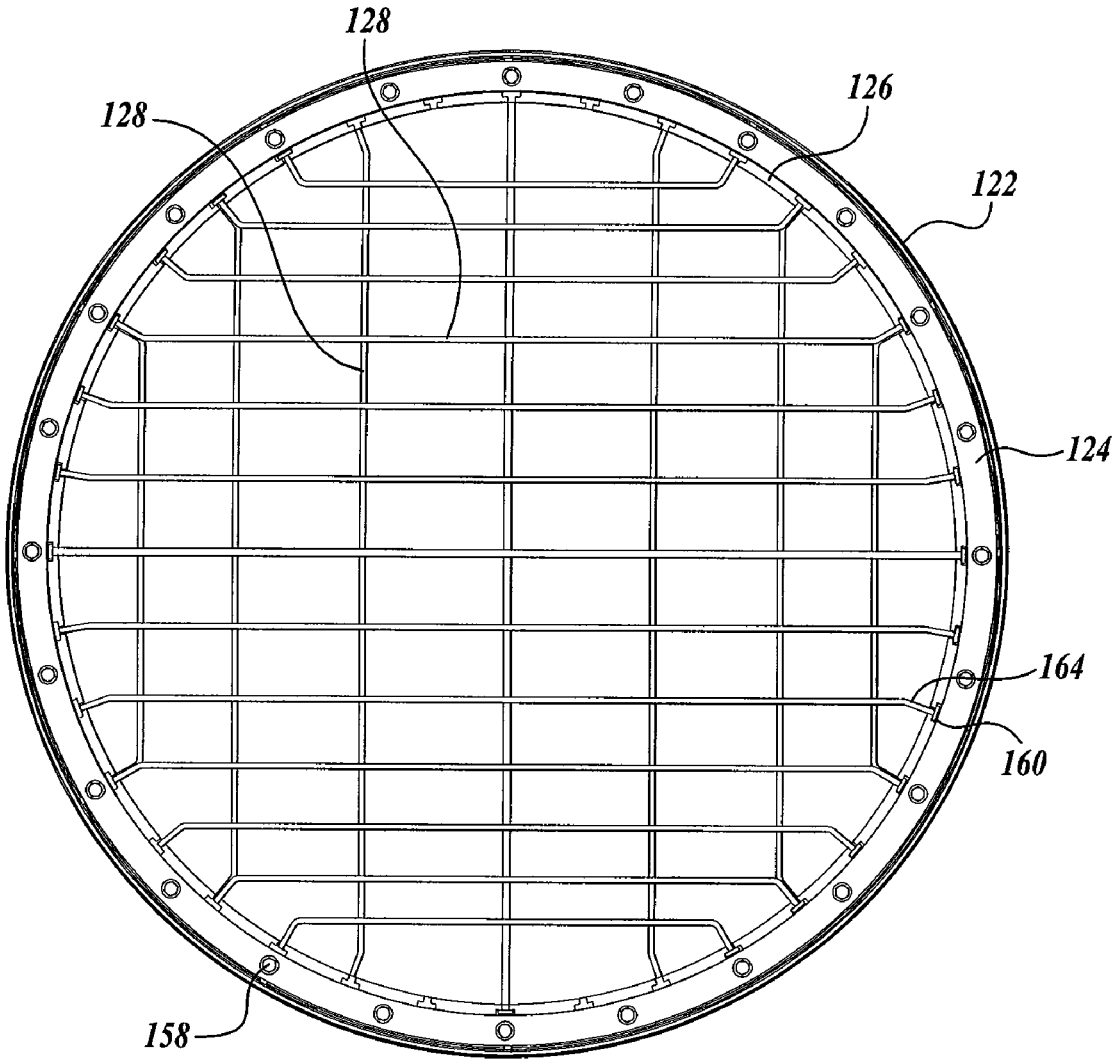
FIG. 6 is a top internal view of the canister assembly of FIG. 5, shown without a closure assembly installed.
Figure 7:
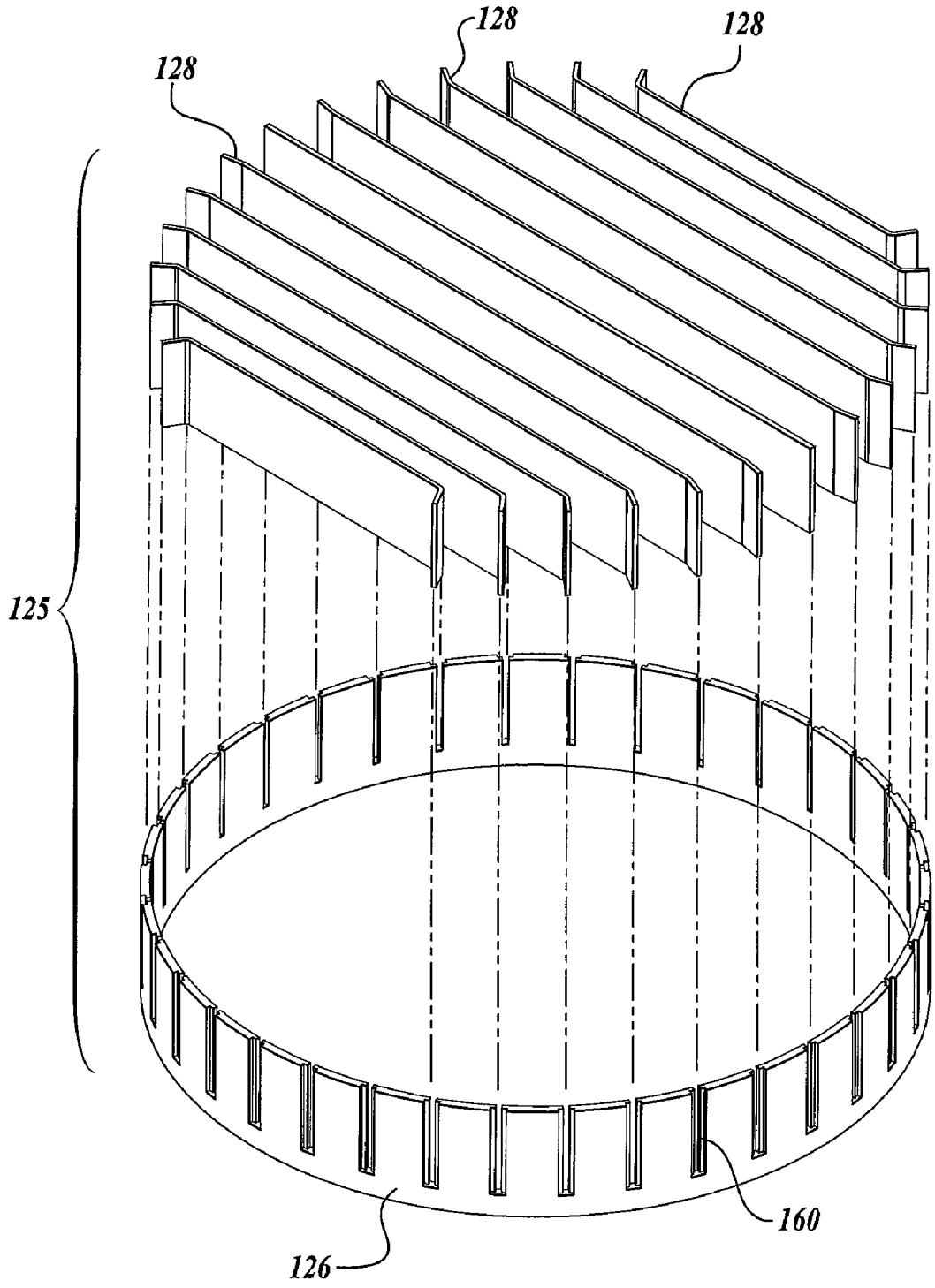
FIG. 7 is an exploded view of the partition support assembly of the canister assembly of FIG. 5.

Non-radial partition configurations are within the scope of the present disclosure. As non-limiting examples of non-radial embodiments, referring to FIGS. 5-7, the partitions 128 are elongate rectangularly shaped partitions oriented in substantially parallel horizontal or vertical rows (see, e.g., FIG. 6), or a combination of such. For example, as seen in FIG. 5, one inner support ring 126 may include substantially parallel horizontal rows of partitions 128 and another inner support ring 126 may include substantially parallel vertical rows of partitions 128. The partitions 128 may be bent along their lengths, for example, to include elbows 164 at their distal ends (see FIG. 6), to conform to the radially designed notches 160.

Figure 8:
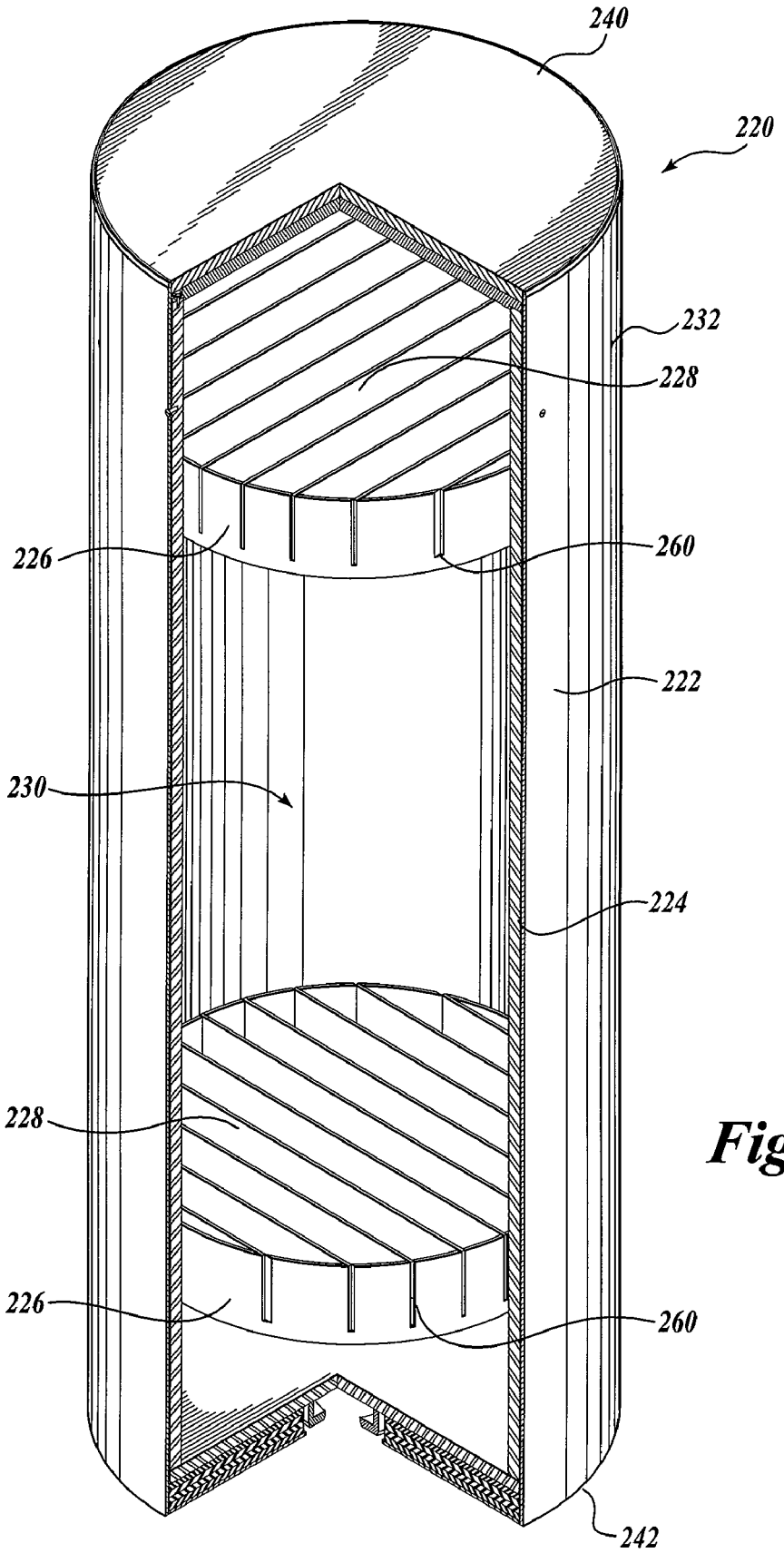
FIG. 8 is a perspective cut-away front view of a canister assembly in accordance with another embodiment of the present disclosure.
Figure 9:
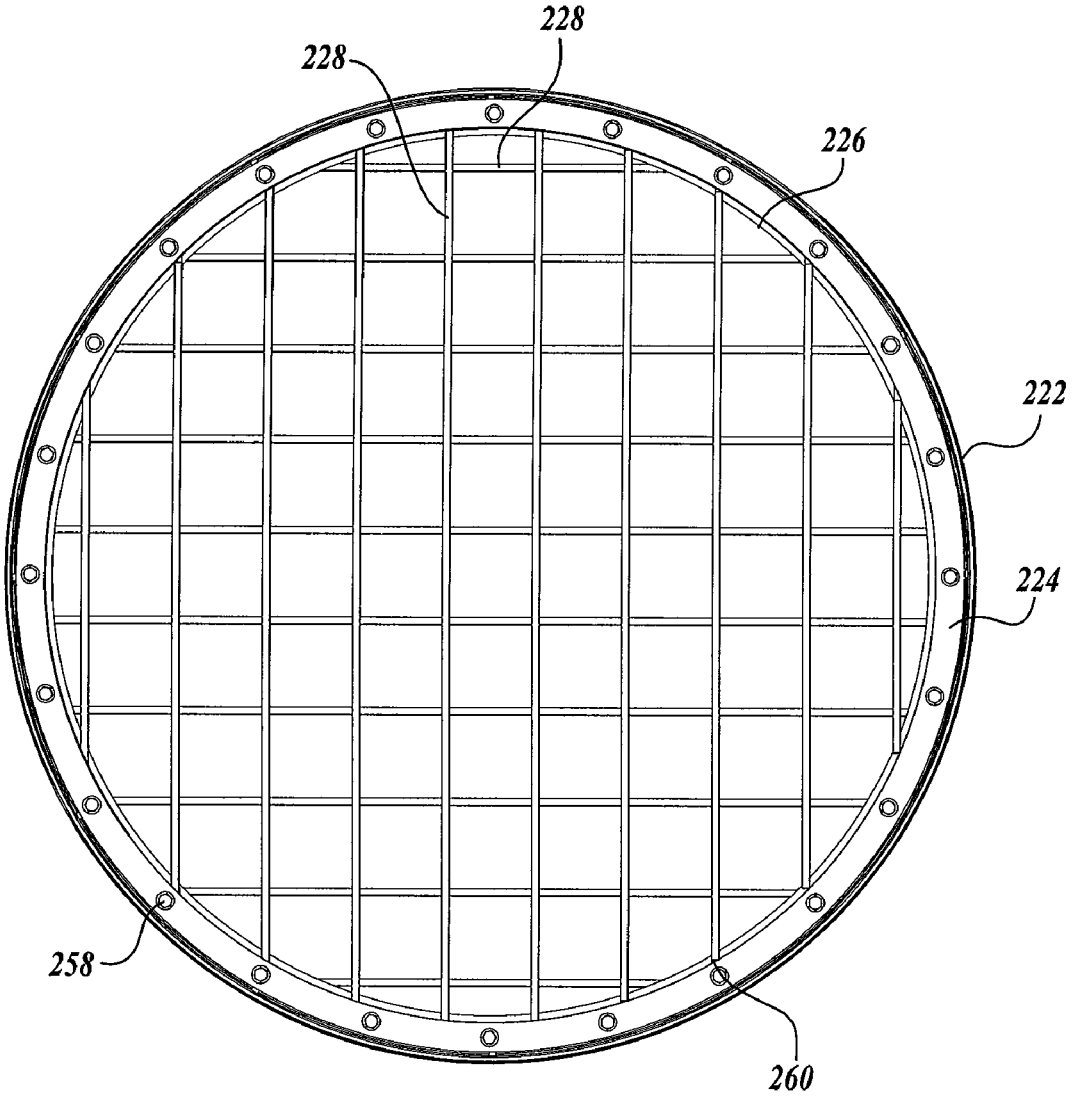
FIG. 9 is a top internal view of the canister assembly of FIG. 8, shown without a closure assembly installed.
Figure 10:
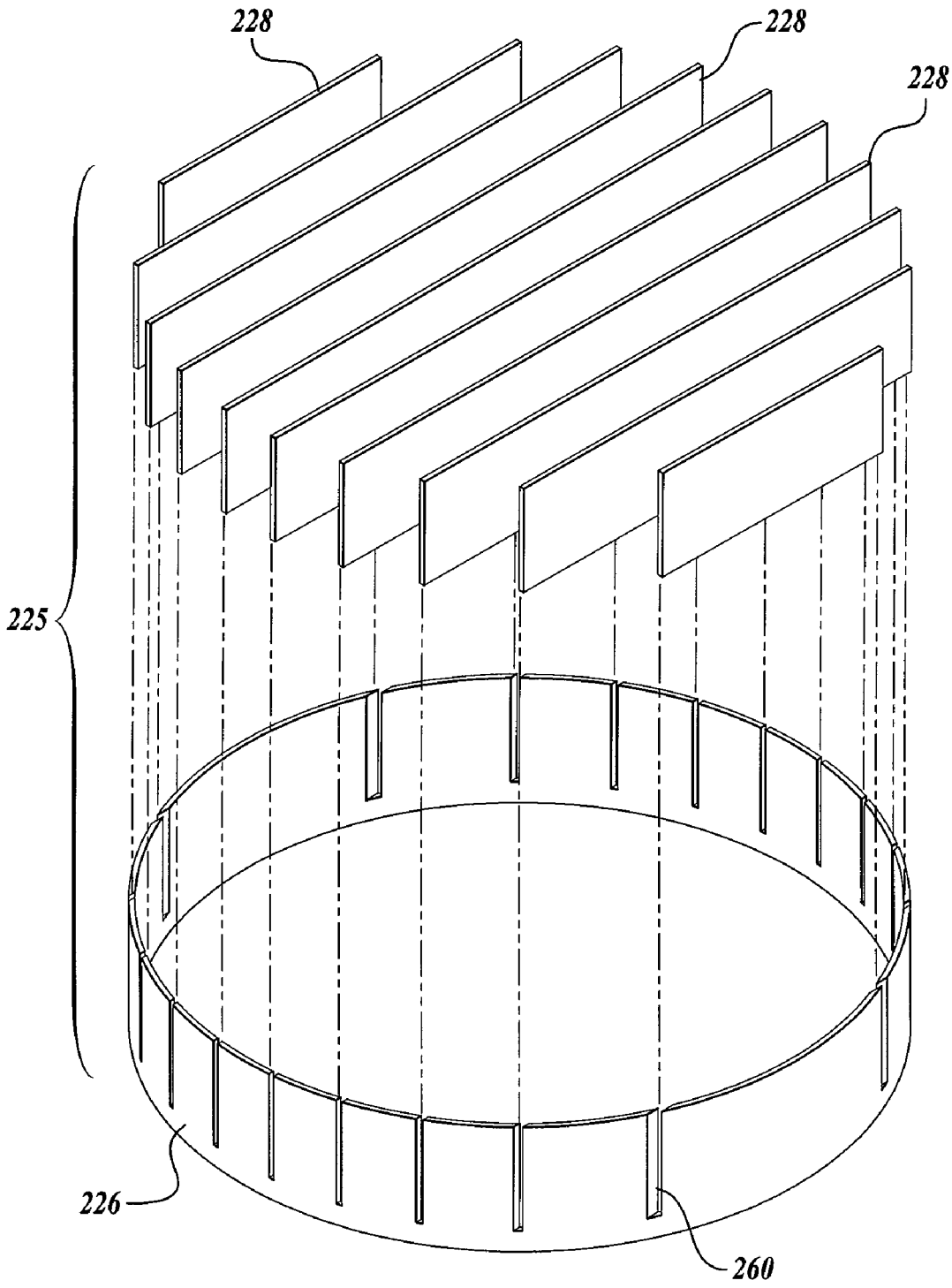
FIG. 10 is an exploded view of the partition support assembly of the canister assembly of FIG. 9.

Referring to FIGS. 8-10, in another embodiment, the notches 260 may be designed in other orientations relative to the inner support ring 226 to support other non-radial partition configurations without requiring bending the partitions 228 along their lengths, such as substantially parallel configurations.

The advantage of these embodiments is that the same standard universally adaptable design, including pre-machined and notched inner support rings and partitions, can be easily changed to accommodate different packaging contents. For example, the embodiment shown in FIG. 1 can be quickly changed to the embodiment shown in FIG. 5 merely by changing out the partitions for rapid loading of packaging contents, such as irradiated hardware. Moreover, embodiments of the present disclosure may include more or fewer partitions than those shown in the illustrated embodiments for versatility and to accommodate differently sized packaging contents.

A method of containing irradiated hardware using the canister assembly will now be described in greater detail. The method includes loading a first packaging content, such as irradiated hardware, in a portion of a canister assembly and temporarily containing the canister assembly in an overpack assembly for a first period of time. After the canister assembly has been contained in the overpack assembly for a first period of time, the canister assembly can be removed from the overpack assembly, opened, and reloaded with a second packaging content, such as irradiated hardware, in another portion of the canister assembly. The reloaded canister assembly can then be contained in the overpack assembly for a second period of time.

This process of reloading may occur over any duration of time period and for as many reloads as required, or until the canister assembly is substantially or fully loaded with packaging contents. For example, in one suitable application, the canister assembly may be configured to receive multiple cycles of irradiated hardware, such as control rods and blades, from multiple cycles of nuclear reactor operations. After, for example, 7 additional cycles of nuclear reactor operations, the canister assembly can be permanently welded and permanently stored in a suitable storage overpack assembly or transported in a transport overpack assembly.

It should be appreciated that the canister assembly may be wet loaded, for example, loaded in a spent fuel pool or pond, storage pool, or containment pool, or dry loaded. If wet loaded, it should be appreciated that embodiments of the canister assembly within the scope of the present disclosure may include suitable drainage and/or drying systems for removing or draining water and/or other fluids from the assembly.

While illustrative embodiments have been illustrated and described, it will be appreciated that various changes can be made therein without departing from the spirit and scope of the present disclosure.

The embodiments of the present disclosure in which an exclusive property or privilege is claimed are defined as follows:

1. A canister assembly, comprising:

(a) a substantially cylindrical outer wall;

(b) a substantially cylindrical inner wall disposed within the outer wall; and (c) at least one inner substantially circular support ring disposed within the inner wall, wherein the one inner support ring includes a plurality of radially oriented notches; and (d) a plurality of first and second partitions for dividing the interior of the canister assembly into first and second distinct packaging orientations for packaging contents to be received within the canister assembly, wherein the plurality of first partitions are receivable in the plurality of radially oriented notches in the first substantially radial packaging orientation and wherein the plurality of second partitions are receivable in the radially oriented notches in the second substantially parallel packaging orientation.

2. The canister assembly of claim 1, wherein the plurality of second partitions have a length and ends extending from the length that are bent relative to the direction of the length to extend in a parallel packaging orientation.

3. The canister assembly of claim 1, wherein the plurality of first partitions are received in the radially oriented notches and oriented to extend radially inwardly from the at least one inner support ring.

4. The canister assembly of claim 1, wherein the plurality of second partitions are received in the radially oriented notches and oriented in the at least one support ring in substantially parallel rows.

5. The canister assembly of claim 1, wherein the canister assembly includes a first end and a second end.

6. The canister assembly of claim 5, wherein the canister assembly includes an openable bolted closure assembly at either of the first end or the second end.

7. The canister assembly of claim 5, wherein the canister assembly has a longitudinal axis extending from the first end to the second end, and wherein the partitions are oriented substantially transverse to the longitudinal axis.

8. The canister assembly of claim 5, wherein the at least one inner substantially circular support ring extends for only a portion of the distance between the first and second ends.

9. The canister assembly of claim 1, wherein the outer wall is made from carbon steel or stainless steel.

10. The canister assembly of claim 1, wherein the inner wall is made from carbon steel or stainless steel.

11. The canister assembly of claim 1, wherein the at least one inner support ring is made from carbon steel or stainless steel.

12. The canister assembly of claim 1, wherein one or more partitions are made from carbon steel or stainless steel.

13. The canister assembly of claim 1, wherein the plurality of first partitions are oriented in a star configuration.

14. A partition support assembly for a substantially cylindrical canister assembly, comprising:

(a) at least one substantially circular support ring configured to support at least one partition for dividing the interior of the partition support assembly for packaging irradiated hardware, wherein the inner support ring includes a plurality of radially oriented notches; and (b) a plurality of first and second partitions for configuring the interior of the canister assembly into first and second distinct packaging orientations for packaging contents to be received within the canister assembly, wherein the plurality of first partitions are receivable in the radially oriented notches in the first substantially radial packaging orientation and wherein the plurality of second partitions are receivable in the plurality of radially oriented notches in the second substantially parallel packaging orientation.

15. The partition support assembly of claim 14, wherein the plurality of second partitions have a length and ends extending from the length that are bent relative to the direction of the length to extend in other directions besides radially inwardly from the at least one inner support ring.

16. The partition support assembly of claim 14, wherein the plurality of first partitions are received in the radially oriented notches and oriented to extend radially inwardly from the at least one support ring.

17. The partition support assembly of claim 14, wherein the plurality of second partitions are received in the radially oriented notches and oriented in the at least one support ring in substantially parallel rows.

18. The partition support assembly of claim 14, wherein the at least one support ring is substantially cylindrical in shape having a substantially circular cross-section.

19. A canister assembly, comprising:

(a) a substantially cylindrical outer wall;

(b) a substantially cylindrical inner wall disposed within the outer wall; and (c) at least one inner substantially circular support ring disposed within the inner wall, wherein the inner support ring includes a plurality of parallel oriented notches around the circumference of the support ring; and (d) a plurality of partitions for dividing the interior of the canister assembly for packaging contents to be received within the canister assembly, wherein the partitions are configurable in the plurality of parallel oriented notches in substantially parallel packaging orientations.

20. A canister assembly, comprising:

(a) a substantially cylindrical outer wall;

(b) a substantially cylindrical inner wall disposed within the outer wall; and (c) at least one inner substantially circular support ring disposed within the inner wall, wherein the inner support ring includes a plurality of radially notches around the circumference of the support ring; and (d) a plurality of partitions for dividing the interior of the canister assembly for packaging contents to be received within the canister assembly in a substantially parallel packaging orientation, wherein the plurality of partitions have a length and ends extending from the length that are bent relative to the direction of the length.

* * * * *